US006374927B1

(12) United States Patent
Guterman et al.

(10) Patent No.: US 6,374,927 B1
(45) Date of Patent: Apr. 23, 2002

(54) PIPE RETENTION AND CARTRIDGE LOCKING SYSTEM FOR A HORIZONTAL DIRECTIONAL DRILL

(75) Inventors: Mark Guterman, Apple Valley, MN (US); Jeffrey S. Volden, Burlington, IA (US)

(73) Assignee: Case Corporation, Racine, WI (US)

( * ) Notice: Subject to any disclaimer, the term of this patent is extended or adjusted under 35 U.S.C. 154(b) by 0 days.

(21) Appl. No.: 09/489,185

(22) Filed: Jan. 20, 2000

(51) Int. Cl.[7] ..... E21B 19/14; E21B 19/15; E21B 7/04; B66F 11/00

(52) U.S. Cl. ..... 175/52; 175/86; 414/746.4; 173/185

(58) Field of Search ..... 175/52, 62, 85, 175/162, 185, 203, 220; 414/22.51, 22.54, 22.58, 22.62, 22.63, 22.65, 22.68, 745.1, 746.4; 173/185

(56) References Cited

U.S. PATENT DOCUMENTS 3,696,944 A * 10/1972 Campbell ..... 414/22.63
3,844,420 A * 10/1974 Walling et al. ..... 414/746.2
5,607,280 A * 3/1997 Rozendaal ..... 414/745.7
6,074,153 A * 6/2000 Allen ..... 414/22.53
6,179,065 B1 * 1/2001 Payne et al. ..... 175/24

FOREIGN PATENT DOCUMENTS

EP 0477728 A1 * 1/1992

* cited by examiner

*Primary Examiner*—David Bagnell
*Assistant Examiner*—Jennifer Hawkins
(74) *Attorney, Agent, or Firm*—Richard G. Lione; Brinks Hofer Gilson & Lione

(57) ABSTRACT

A dual purpose bracket assembly for a horizontal directional drill that retains pipes within a cartridge when the cartridge is detached from the drill and locks the cartridge to the drill when it is attached. The bracket assembly includes side plates that are installed within longitudinal support members. A pivot pin is installed through the side plates and the longitudinal support members and allows the bracket assembly to rotate between a pipe retention position and a locked position. A dual purpose removable pin supports the weight of the pipes in the pipe retention position when the cartridge is detached and locks the cartridge to the drill when the cartridge is attached.

16 Claims, 3 Drawing Sheets

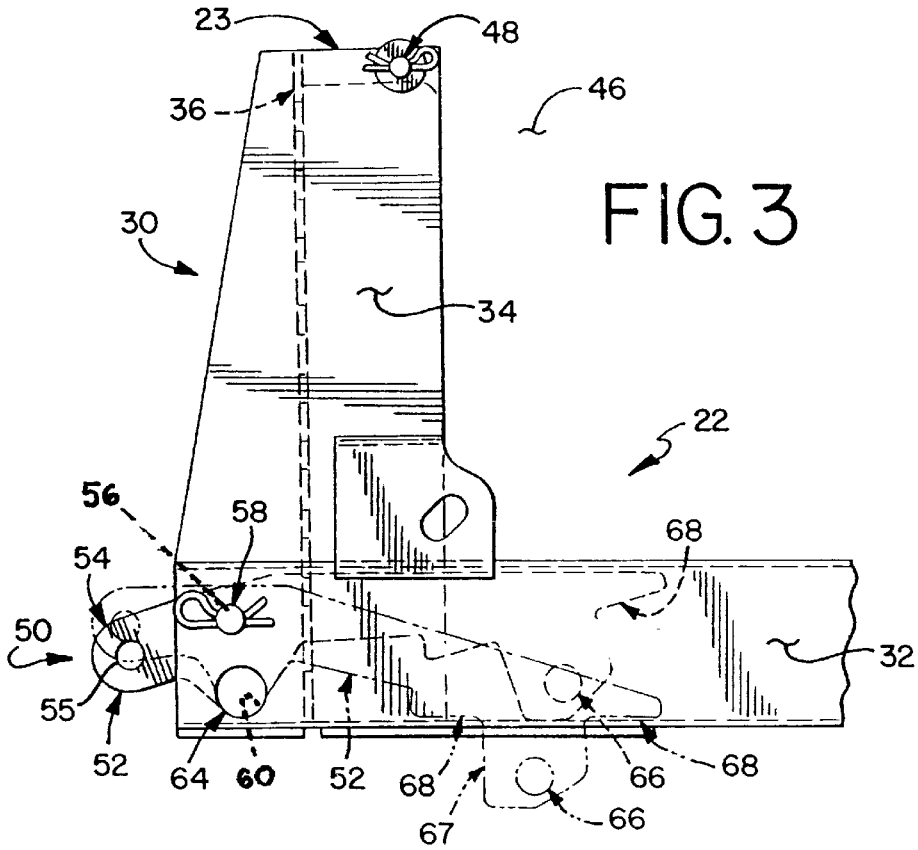
FIG. 3
FIG. 4
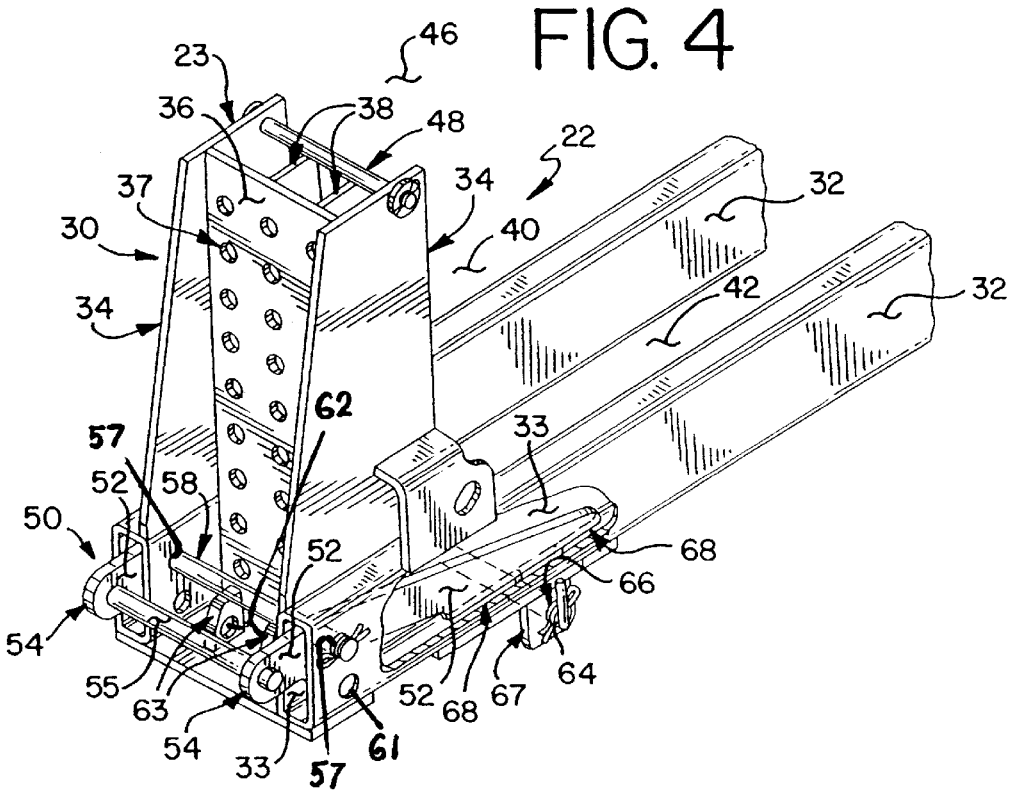

PIPE RETENTION AND CARTRIDGE LOCKING SYSTEM FOR A HORIZONTAL DIRECTIONAL DRILL

FIELD OF THE INVENTION

The present invention relates generally to horizontal directional drill machines. It relates particularly to a pipe retention and cartridge locking system for a horizontal directional drill machine.

BACKGROUND OF THE INVENTION

A horizontal directional drill machine is a common and well-known machine for installing pipes beneath the ground and generally parallel to the surface. These machines are used in many different applications and are available in a wide range of sizes. Typical applications where a horizontal directional drill machine might be used include the installation of fiber optic cables, electrical cables, gas lines, water systems, or sewer systems. Horizontal directional drill machines are commonly rated in terms of pull-back capacity. Some machines for smaller applications have as little as five thousand pounds of pull-back capacity. Other machines are available with a pull-back capacity of as much as one million pounds.

One alternative to a horizontal directional drill machine is the traditional trencher machine. A trencher machine simply digs a trench into the ground, and after (for example) pipe is laid down in the bottom of the trench, the trench is filled and the pipe is buried. The advantage of a horizontal directional drill machine over a trenching machine is that a pipe can be buried in the ground over long distances without digging a trench. Thus, a horizontal directional drill is particularly desirable when a trench would be difficult or too costly to dig. For example, a horizontal directional drill machine finds particularly advantageous application for installing pipes under roadways, where destruction of the road is expensive and inconvenient to travelers, or under a waterway like a river, where trenching would be impossible.

A unique aspect of a horizontal directional drill machine is the special drill head that is attached to the front end of a pipe to be laid. The drill head has an angled shape which allows the operator to change the direction of the pipe after it has entered the ground. Direction changes are achieved by stopping the pipe and drill head rotation and orienting the drill head at a desired angle. Then, by pushing on the drill pipe without rotating it, the drill head and attached pipe will veer in the desired direction. Thus, by effecting directional changes to pipe travel, a pipe might enter the ground at an angle, travel horizontally over a long distance, and exit the ground at another angle. This ability to change the direction of pipe travel also allows the operator to steer the pipe around underground obstacles like boulders.

A completely drilled pipe length is made up of an assembly of shorter pipe lengths that are attached to each other end to end. As the pipe is drilled through the ground, successive pipe lengths are attached to the preceding pipe assembly to provide additional length. The additional pipe lengths are stored on the drill machine in a cartridge. The bottom pipes in the cartridge feed down through an opening in the bottom of the cartridge and are successively attached to the preceding pipe assembly with the aid of a loader.

Preferably, the cartridge is detachable from the drill machine body. This feature allows a cartridge to be reloaded with new pipe lengths at a place away from the drill machine. Additionally, the drill machine can continue operations after a relatively quick exchange of the empty cartridge for a new, fully loaded cartridge without the delay that would be associated with reloading pipes individually.

Because the bottom of the cartridge is open to allow downward feeding of the pipes when the cartridge is seated in the drill machine, a system is required to obstruct this opening and prevent the pipes from falling through the opening when the cartridge is detached from the drill. Additionally, a system is required to lock the cartridge in place when the cartridge is attached, to prevent unwanted movement of the cartridge. Naturally, systems that are simple and less costly are the most desirable.

BRIEF SUMMARY OF THE INVENTION

It is therefore an object of the invention to provide a system that performs the dual functions of retaining pipe segments within a cartridge when the cartridge is detached, and locking the cartridge to the drill machine when the cartridge is attached.

It is another object of the present invention to provide a system including a bracket assembly that obstructs the bottom opening in a cartridge and prevents pipes from falling through the opening when the cartridge is detached from the drill machine.

It is a further object to provide a bracket assembly which allows the pipes to feed through the bottom opening and lock the cartridge to the drill machine when the cartridge is attached.

According to the invention, a bracket assembly is provided at each end of a cartridge. The bracket assemblies are identical. Each bracket assembly includes opposed side plates which are attached together with a handle which fixedly aligns the side plates with each other. The side plates are mounted within hollow, longitudinal support members of a cartridge. A set of pivot holes extend through the side plates and the longitudinal support members. A pivot pin is installed through the pivot holes and allows the bracket assembly to rotate between a pipe retention position and a locked position.

A set of pipe retention holes extend through a lower portion of the side plates. In the pipe retention position, the lower portion of the side plates extend through open slots in the bottom of the longitudinal support members. A dual purpose removable pin is then installed through the pipe retention holes and extends transversely below the bottom opening of the cartridge, thereby supporting the weight of the pipes.

In the locked position, the dual purpose removable pin is installed through holes in the longitudinal support members, the side plates, and locking flanges that are fixedly attached to the drill, thereby locking the cartridge to the drill. In this position, the bracket assembly is rotated so that the lower portion of the side plates retracts within the hollow portion of the longitudinal support members to prevent interference between the side plates and the loader mechanisms.

BRIEF DESCRIPTION OF SEVERAL VIEWS OF THE DRAWINGS

The invention, including its construction and method of operation, is illustrated more or less diagrammatically in the drawings, in which:

FIG. 3 is a side elevational view of one end of a cartridge, showing the dual purpose bracket assembly in the pipe retention position and phantom lines showing the locked position; and FIG. 4 is a perspective view of part of one end of a horizontal directional drill, with the cartridge attached and locked to the drill body.

DETAILED DESCRIPTION OF THE INVENTION

Figure 1:
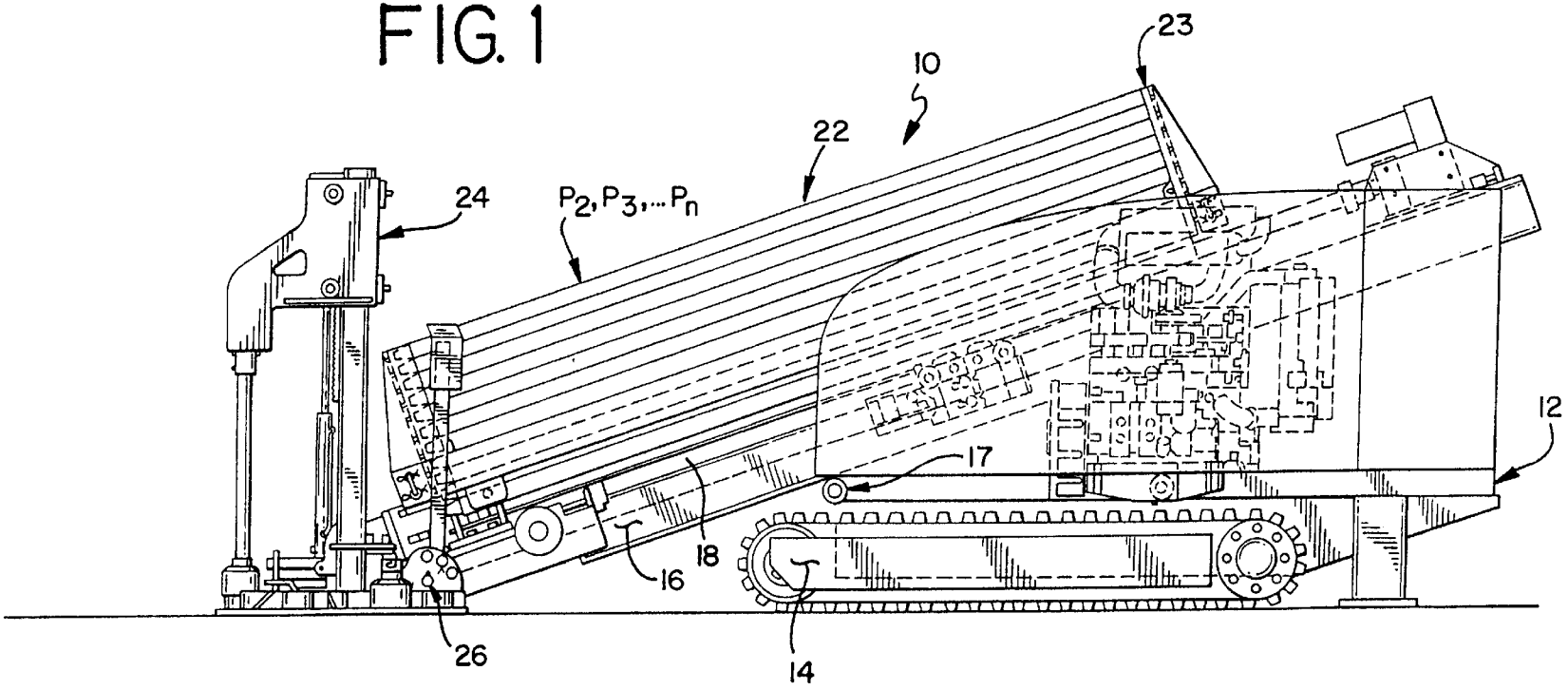
FIG. 1 is a side elevational view of a horizontal directional drill, showing the drill in its operating mode with the cartridge fully loaded with pipes and the dual purpose bracket assembly in the locked position.

Referring now to the drawings, and particularly to FIG. 1, a horizontal directional drill machine is shown generally at 10. The drill machine 10 includes a frame 12 supported by driven tracks 14 for moving the drill machine 10 from place to place.

The drill machine 10 includes a longitudinally elongated boom 16 pivotally mounted on the front end of the frame 12, as at 17. A conventional pipe drill assembly 18 is mounted on the boom 16, extending coextensively therewith. The drill assembly 18 is designed to drill a series of pipe sections $P_1$, $P_2$, $P_3$, et seq., into the ground, in sequence.

In the operating mode of the drill machine 10, the boom 16 is pivoted upward away from the frame 12 so that pipe section $P_1$ extends from the drill assembly 18 and intersects the ground at an angle. A special drill head (not shown) is attached to the front end of the first drill pipe section $P_1$. In order to drill the pipe section $P_1$ into the ground and make any desired directional changes in its path, a variety of push, pull, and rotational forces are applied to the pipe section $P_1$ by the drill assembly 18. The manner in which the drill assembly 18 applies these forces to the drill pipe section $P_1$ are not described, but are well known to those skilled in the art.

As the first pipe section $P_1$ is drilled into the ground, new pipe sections $P_2$, $P_3$, et seq., are successively attached to the rear end of the preceding pipe sections. A cartridge 22 of pipe sections $P_2$, $P_3$, et seq. is provided on the boom 16 for storing these additional pipe sections, and a semi-automatic or fully automatic loader (not shown) may be provided for attaching them to the preceding pipe sections.

A stakedown assembly 24 is connected to the front end of the drill machine 10. The stakedown assembly 24 is attached to forward end of the boom 16 at a pivot connection 26, which allows the stakedown assembly 24 to be oriented level with the ground surface when the boom is tilted.

Figure 2:
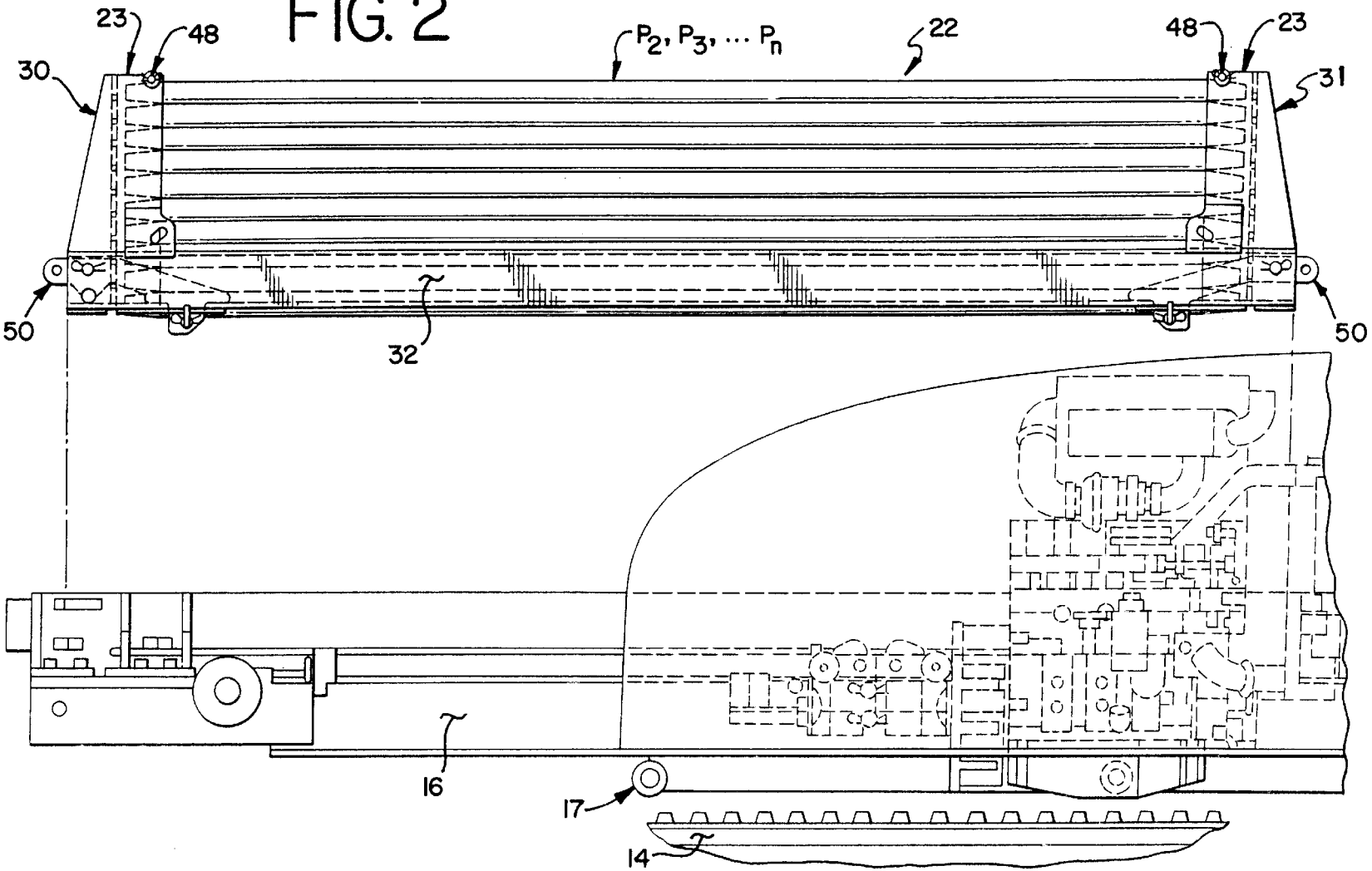
FIG. 2 is a side elevational view of a horizontal directional drill, showing the drill in its transport mode with the cartridge disconnected from the drill body.

Turning now primarily to FIG. 2, a pipe cartridge 22 is provided on the boom 16 for storing the additional pipe lengths P. A tower 30 is provided at the front end and a tower 31 is provided at the rear end of the cartridge 22 for structural support and to retain the pipes P within the cartridge 22. Connecting the two towers 30 and 31 are longitudinal support members 32 which extend along a lower part of the cartridge 22 on the outer sides.

To restrain the pipes P from side-to-side movement on the outer sides, the towers 30 and 31 include side plates 34 which extend longitudinally along a part of the outer side of the cartridge 22 and along the ends of the pipe length P. The side plates 34 further extend up to the top 23 of the cartridge 22, thus restraining the pipe lengths P. Restraining the pipes lengths P from end-to-end movement are end plates 36 that extend between the side plates 34 and up to the top edge 23 of the cartridge 22. A number of drain holes 37 are provided through the end plates 36 to allow water, sludge, and other debris to escape from the interior of the cartridge 22.

Several columns of pipe lengths P are stored within the cartridge 22, and dividing plates 38 (see FIG. 4) are provided for separating the columns of pipe lengths P. The dividing plates 38 are attached to the end plates 36 and extend up to the top 23 of the cartridge 22 and longitudinally along the ends of the pipe lengths P.

As new pipe lengths P are required for the drilling operation, those at the bottom of the cartridge 22 successively feed down through a bottom open portion 42 to a loader (not shown). The bottom open portion 42 extends between the longitudinal support members 32 and the end plates 36. The loader, which is part of the boom assembly 16, attaches each new pipe length P to the preceding pipe assembly and may be semi-automatic or fully automatic.

Along the top side of the cartridge 22, an open portion 46 extends between the side plates 34 and the end plates 36 for reloading the cartridge 22 with new pipes 20 when the cartridge 22 is detached from the drill machine 10. Extending across the top open portion 46 are removable retention pins 48 that are installed through the side plates 34 and prevent the pipes P from dislodging out of the cartridge 22 through the top open portion 46.

Turning now to FIGS. 3 and 4 in addition to FIG. 2, the cartridge 22 is detachable from the drill machine 10 to allow the cartridge 22 to be reloaded with pipes P at a place away from the drill 10. Because, as previously discussed, an open portion 42 must be provided when the cartridge 22 is attached to the drill 10 along the bottom of the cartridge 22, a system is provided to obstruct this opening 42 when the cartridge 22 is detached from the drill machine 10 to prevent the pipes from falling down through the open portion 42. Additionally, the cartridge 22 is fixedly locked to the drill machine 10 when attached to prevent unwanted movement of the cartridge 22. Identical, dual purpose bracket assemblies 50 are provided at each end of the cartridge 22 to satisfy both of these needs.

Each bracket assembly 50 includes two side plates 52, each extending longitudinally within corresponding hollow portions 33 of the longitudinal support members 32. A portion 54 of each side plate 52 extends beyond the end of the corresponding longitudinal support member 32. Connecting the corresponding end portions 54 is a handle 55 that is fixedly attached to each of the end portions 54 so that the side plates 52 are fixedly aligned with each other. The handle 55 also provides the operator with a convenient grasp for pivoting the bracket assembly 50.

A pivot hole 56 is provided through each of the side plates 52. Corresponding pivot holes 57 extend through the longitudinal support members 32. A pivot pin 58 is installed through the longitudinal support member pivot holes 57 and the side plate pivot holes 56. The bracket assembly 50 pivots about the pin 58.

A locking hole 60 is also provided through each of the side plates 52. Corresponding locking holes 61 also extend through the longitudinal support members 32. A pair of locking flanges 63 fixedly attached to the boom 16 include matching locking holes 62. A dual purpose removable pin 64 can then be installed through the locking holes 61, 60, 62 of the longitudinal support members 32, the side plates 52, and the locking flanges 63 to lock the cartridge 22 to the drill 10.

Finally, a set of pipe retention holes 66 are provided through corresponding ears 67 depending from each of the side plates 52. When the bracket assembly 50 is pivoted down (at the rear) about the pivot pin 58, the ear 67 on each side plate 52 extends below the corresponding longitudinal support member 32 through a open slot 31 in the bottom of the longitudinal support member 32. In this position, the removable pin 64 can be installed through the pipe retention holes 66 so that the pin 64 extends transversely below the bottom of the cartridge 22.

As is readily apparent from the foregoing discussion and the drawings, the dual purpose bracket 50, therefore, fulfills both the function of locking the cartridge 22 to the drill machine 10 when attached, and supporting the drill pipes P within the cartridge 22 when detached. In the pipe retention mode, the bracket assembly 50 is rotated about the pivot pin 58 so that the ears 67 on the side plates 52 extends through the open slots 31 in the bottom of the longitudinal support members 32, and the removable pin 64 is installed through the pipe retention holes 66 which are positioned below the bottom side of the cartridge 22. The cartridge 22 can then be loaded with new pipes 20 through the open portion 46 along the top side of the cartridge 22, after removing the top retention pins 48. When fully loaded with pipes 20, the bottom pipes 20 rest on the two removable pins 64 installed at each end of the cartridge 22. The weight of the loaded pipes 20 is transferred to the longitudinal support members 32 from the removable pins 64 through a support flange 68 on the side plates 52 that is larger than the open slots 31 and abuts against the interior of the longitudinal support members 32.

To attach the fully loaded cartridge 22 to the drill 10, the cartridge 22 is lowered onto the boom 16. The loader lifts the pipes P slightly through the bottom side open portion 42 so that the weight of the pipes 22 is released from the removable pins 64. The cartridge 22 rests on the boom 16 along the bottom sides of the longitudinal support members 32. The pins 64 can then be removed from the bracket assembly 50.

With the handle 55, the bracket assembly 50 is next rotated so that the ears 67 on the side plates 52 are retracted within the hollow portions 33 of the longitudinal support members 32 to prevent interference with the loader mechanisms. The removable pins 64 at each end of the cartridge 22 are finally installed through the locking holes 61, 62, 60 in the longitudinal support members 32, the locking flanges 63, and the bracket assembly 50. In this position, the removable pins 64 lock the cartridge 22 to the drill 10 and also retain the bracket assemblies 50 in a storage position within the longitudinal support members 32.

While a preferred embodiment of the invention has been described, it should be understood that the invention is not so limited, and modifications may be made without departing from the invention. The scope of the invention is defined by the appended claims, and all devices that come within the meaning of the claims, either literally or by equivalence, are intended to be embraced therein.

What is claimed is:

1. A cartridge and support structure for a horizontal directional drill assembly, comprising:

a) a drill assembly on said support structure;

b) support structure providing torsional stability to said cartridge;

c) an opening on a bottom side of said cartridge for allowing drilling pipes to feed out of the cartridge and into said drill assembly;

d) said cartridge being detachable from said drill assembly support structure;

e) a bracket assembly including, i) side members, with ii) said side members being pivotally attached to said cartridge; and f) a multiple position locking mechanism movable between i) a first position that restrains said bracket assembly in a storage position and allows said drilling pipes to feed out through said bottom side open portion, and ii) a second position that allows the bracket assembly to support the weight of the drilling pipes to prevent the drilling pipes from feeding out through said opening;

g) said multiple position locking mechanism being effective, when in said first position, to lock said cartridge to said drill assembly support structure.

2. The assembly according to claim 1 wherein said mechanism includes two locking mechanisms.

3. The assembly according to claim 1 wherein said multiple position locking mechanism includes holes in said side members and a locking pin.

4. The assembly according to claim 3 wherein said support structure includes hollow longitudinal support members that allow said side members to be installed within the hollow portions.

5. The assembly according to claim 4 wherein openings are provided in said longitudinal support members to allow a portion of said side members to extend outside of said hollow portion therein allowing said locking pin to engage a second set of said holes in the outside portion of the side members.

6. A horizontal directional drill comprising:

a) a drill and a cartridge;

b) a support structure mounting said drill assembly and providing torsional stability to said cartridge;

c) an open portion on a bottom side of said cartridge for allowing drilling pipes to feed out of the cartridge and into said drill assembly;

d) said cartridge being detachable from said support structure;

e) a bracket assembly;

f) a pivot pin that rotatably attaches said bracket assembly to said cartridge; and g) a multiple position locking pin extending transversely of said cartridge and having;

i) a first installed position in which it simultaneously locks said cartridge to said support structure and locks said bracket in a storage position; and ii) a second installed position in which it allows the bracket assembly to support the weight of drilling pipes stored within the cartridge.

7. The drill according to claim 6 wherein two bracket assemblies are rotatably attached to said cartridge, one at each end of said cartridge and a multiple position locking pin is associated with each bracket assembly.

8. The drill according to claim 7 wherein said support structure includes hollow longitudinal support members that allow each bracket assembly to be installed within the hollow portions.

9. The drill according to claim 8 wherein openings are provided in said longitudinal support members to allow a portion of each bracket assembly to extend outside of said hollow portion therein allowing each locking pin to engage the outside extending portion when in said second installed position.

10. The drill according to claim 9 wherein the weight of said drilling pipes when each locking pin is in said second installed position is transferred from the locking pin to said support structure by an extended portion of said corresponding bracket assembly that abuts against an inside surface of said hollow portion.

11. A cartridge arrangement in a horizontal directional drill comprising:

a) longitudinal support members extending along a lower portion of said cartridge and positioned outside of drilling pipes stored within the cartridge;

b) said cartridge including,
   i) end plates for restricting longitudinal movement of said drilling pipes,
   ii) side plates for restricting side-to-side movement of the drilling pipes,
   iii) an open portion on a top side of the cartridge for loading the drilling pipes into the cartridge, and
   iv) an open portion on a bottom side of the cartridge for allowing the drilling pipes to feed out of the cartridge and into a drill body;

c) said cartridge being detachable from said drill body;

d) a bracket assembly including,
   i) side members,
   ii) a pivot pin for attaching the bracket assembly to said cartridge, and
   iii) means for aligning the side members to each other;

e) said cartridge including two of said bracket assemblies;

f) a locking pin;

g) holes in said side members including,
   i) a first set of holes positioned to allow said locking pin to restrain said bracket assembly in a storage position when said cartridge is attached to said drill body that allows said drilling pipes to feed out through said bottom side open portion, and
   ii) a second set of holes positioned to allow the locking pin to support the weight of the drilling pipes when the cartridge is detached from the drill body;

h) holes in said drill body positioned to allow said locking pin to fixedly attach said cartridge to the drill body when the locking pin is installed in said first set of holes i) means by which the weight of said drilling pipes is transferred to said longitudinal support members when said locking pin is installed in said second set of holes; and j) a lifting means on said drill body for releasing the weight of said drilling pipes from said locking pin to allow removal of the locking pin from said second set of holes.

12. The cartridge arrangement according to claim 11 wherein said longitudinal support members are hollow so that said side members are installed within said hollow portion.

13. The cartridge arrangement according to claim 12 wherein openings are provided in said longitudinal support members to allow said second set of holes in said side members to extend outside of said hollow portion to allow said locking pin to support the weight of said drilling pipes.

14. The cartridge arrangement according to claim 13 wherein said means of transferring the weight of said drilling pipes from said locking pin to said longitudinal support members is an extended portion of said side members that abuts against an inside surface of said hollow portion.

15. The cartridge arrangement according to claim 14 wherein holes are provided in said longitudinal support members that allow said locking pin to extend through said first set of holes in said side members.

16. The cartridge arrangement according to claim 15 wherein said means of aligning said side members is a pin that rigidly connects the side members which can also be used as a handle for positioning said bracket assembly.

* * * * *